US010150154B2

(12) United States Patent
Hughes, Jr.

(10) Patent No.: US 10,150,154 B2
(45) Date of Patent: Dec. 11, 2018

(54) TUBE BENDING MACHINE WITH REVERSIBLE CLAMP ASSEMBLY

(71) Applicant: Robert Kyle Hughes, Jr., Johnson City, TN (US)

(72) Inventor: Robert Kyle Hughes, Jr., Johnson City, TN (US)

( * ) Notice: Subject to any disclaimer, the term of this patent is extended or adjusted under 35 U.S.C. 154(b) by 1016 days.

(21) Appl. No.: 14/541,295

(22) Filed: Nov. 14, 2014

(65) Prior Publication Data

US 2015/0135789 A1 May 21, 2015

Related U.S. Application Data

(60) Provisional application No. 61/904,023, filed on Nov. 14, 2013.

(51) Int. Cl.
*B23P 15/00* (2006.01)
*B21D 43/00* (2006.01)
*B21D 7/024* (2006.01)

(52) U.S. Cl.
CPC ..... *B21D 43/006* (2013.01); *B21D 7/024* (2013.01)

(58) Field of Classification Search
CPC . B23P 11/00; B23P 15/00; B23P 19/00; B23P 19/02; B23P 21/00
See application file for complete search history.

(56) References Cited

U.S. PATENT DOCUMENTS 3,827,126 A * 8/1974 Shiozawa ..... B25H 1/00 29/721
3,889,508 A 6/1975 Sugita
4,038,853 A 8/1977 Schwarze
4,050,685 A * 9/1977 Cox ..... A63C 11/14 269/296
4,178,788 A 12/1979 Zollweg et al.
4,269,054 A 5/1981 Eaton
4,416,136 A 11/1983 Schwarze
4,735,075 A 4/1988 Saegusa
4,805,436 A 2/1989 Saegusa
4,870,849 A 10/1989 Traub
5,315,852 A 5/1994 Talley et al.
5,678,441 A 10/1997 Schwarze
5,852,945 A 12/1998 Burger
5,927,126 A 7/1999 Biella
6,170,141 B1 * 1/2001 Rossway ..... F01D 25/285 206/319

(Continued)

FOREIGN PATENT DOCUMENTS

EP 120336 10/1991
EP 513864 7/1996

(Continued)

*Primary Examiner* — Lee D Wilson

(74) *Attorney, Agent, or Firm* — Pitts & Lake, P.C.

(57) ABSTRACT

A tube bending machine for bending a length of a tubular workpiece and an associated tube feeder assembly are disclosed. The tube feeder assembly has a carriage assembly slidably mounted along a rail. A clamp assembly is reversibly mounted to and carried by the carriage assembly. The clamp assembly is adapted to be releasably secured to the workpiece. The clamp assembly and carriage assembly are configurable to align the workpiece central axis along the rail, whereby sliding of the carriage assembly with the workpiece mounted in the clamp assembly carries the workpiece along the rail.

4 Claims, 7 Drawing Sheets

(56) References Cited

U.S. PATENT DOCUMENTS

| | | | | |
|---|---|---|---|---|
| 6,292,999 | B1 * | 9/2001 | Rossway | F01D 25/285 29/281.1 |
| 7,150,175 | B2 | 12/2006 | Traub | |
| 7,234,333 | B2 | 6/2007 | Maier et al. | |
| 7,891,225 | B2 | 2/2011 | Hammerer et al. | |
| 8,418,340 | B2 * | 4/2013 | Koehnen | B25B 5/003 248/122.1 |
| 8,443,644 | B2 | 5/2013 | Wolf | |
| 2007/0052146 | A1 * | 3/2007 | Huisken | B23Q 3/062 269/63 |
| 2009/0126438 | A1 | 5/2009 | Etienne | |
| 2011/0174035 | A1 | 7/2011 | Ghiran et al. | |

FOREIGN PATENT DOCUMENTS

| | | |
|---|---|---|
| GB | 2166986 | 5/1986 |
| WO | WO2012044181 | 4/2012 |

* cited by examiner

TUBE BENDING MACHINE WITH REVERSIBLE CLAMP ASSEMBLY

CROSS-REFERENCE TO RELATED APPLICATIONS

This application claims the benefit of U.S. Provisional Patent Application Ser. No. 61/904,023, filed on Nov. 14, 2014, which is incorporated herein in its entirety by reference.

STATEMENT REGARDING FEDERALLY-SPONSORED RESEARCH OR DEVELOPMENT

Not Applicable

BACKGROUND OF THE INVENTION

1. Field of Invention

The invention relates to tube bending machines, and particularly, to a reversible clamp assembly for a tube bending machine, and a tube bending machine incorporating a reversible assembly.

2. Description of the Related Art

Numerous buildings, construction sites, manufacturing plants, machine shops, and the like use bent tubes, pipes, bars, rods, or the like (hereinafter, collectively, "tubes") to produce a variety of items such as hand rails, scaffolding, automotive parts, or other fabricated metal products. In the manufacture and forming of tubes, several types of tube bending machines are known which are useful to permanently form tubes to a desired shape. In various tube bending machines, a tube is clamped into place in a clamping block, and a portion of the tube to be bent is positioned within a working area of a forming die. Thereafter, mechanical force is applied to force the portion of the tube to be bent to conform to the forming die. The source of such mechanical force varies depending on the type of tube bending machine, however, several types of tube bending machines rely on human power, pneumatics, hydraulics, electric servomotors, and the like.

One type of tube bending machine is the rotary draw bender. This type of machine uses an annular forming die which is mounted in a coaxial configuration to a rotatable spindle. The forming die has a concave groove extending about at least a portion of a perimeter edge thereof. A fastener is provided at a leading end of the groove to fasten a first end of a tube adjacent the leading end of the groove. A pressure die is provided to maintain the tube adjacent the bending die. The spindle and subordinate forming die are then rotated about their co-axis, whereupon the tube is "drawn" along the groove of the forming die, thereby bending the tube in conformity with the groove.

In several rotary draw bender designs, a clamping block is provided which includes a tubular clamp or chuck adapted to be releasably secured to a second end of the tube, opposite the above-discussed first end. The clamping block is slidably mounted along a support rail which extends from an input end of an interface of the forming die and the pressure die. Thus, as the forming die is rotated and the tube is drawn along the groove of the forming die, the clamping block slides along the support rail in order to "feed" additional tube through the interface of the forming die and the counter die, while simultaneously maintaining the second end of the tube in alignment with a feeding direction of the rotary draw bender.

In certain designs, the clamping block may allow indexed rotation of the tube about the feeding direction of the rotary draw bender, thereby allowing multiple bends to be performed in multiple directions along the length of the tube, wherein the angle of extension of each bend in relation to adjacent bends is controllable via the indexed rotation of the tube within the clamping block. This type of rotary draw bender is often desirable when the need exists to perform multiple bends in multiple directions at precise locations and at precise angles along the length of a tube. However, this type of bending operation presents a number of problems. For instance, use of such a tube bending machine to effect two bends in a single piece of tubing typically involves starting with a straight tubular work piece, forming a first bend proximate a first end of the tube, adjusting the position of the clamping block toward the forming die to allow the bent portion of the tube to move unsupported beyond the forming die and, if necessary, adjusting the rotation of the work piece in relation to the clamping block, and then forming a subsequent bend in the tube. These operations may be repeated to form multiple bends in sequence toward the second end of the tube. However, once the first bend in the tube proximate the first end of the tube is formed, the operation of forming subsequent bends in the tube toward the second end of the tube can result in drastic swinging of the unsupported first end of the tube, due to the geometry of the previous bend(s) and the extension of the first end of the tube beyond the forming die. If the first end of the tube is not properly supported, this can result in warping, deformation, or other inaccuracies in the geometry of the finished tube product.

Furthermore, in the above-discussed rotary tube bender design, in order for the above-discussed indexed rotation of the tube in relation to the clamping block to remain consistent throughout all bending operations performed along the length of the tube, the second end of the tube must remain secured within the chuck of the clamping block throughout each stage of the bending process. In most rotary tube bender designs, the clamping block is incapable of feeding at least a portion of the tube nearest the second end through the interface of the forming die and the counter die. Thus, in previous prior art rotary tube bender designs, it is difficult to perform a bend at or near the second end of the tube without also disconnecting the second end of the tube from the clamping block, thereby sacrificing stability of the tube within the rotary tube bender and potentially allowing inconsistency of measurement of rotation of the tube about the feeding direction during multiple bending processes.

In light of the above, there is a need in the art for a tube bending machine that allows a user to access both ends of a tubular work piece for bending without sacrificing stability of the tube within the rotary tube bender and while limiting inconsistency of measurement of rotation of the tube about the feeding direction during the bending process.

BRIEF SUMMARY OF THE INVENTION

The present general inventive concept, in various example embodiments, provides a tube feeder assembly configured to allow feeding of a tubular workpiece along a central axis of the workpiece from either of opposite ends of the workpiece. In various embodiments, the tube feeder assembly may be incorporated into a tooling machine for tooling a tubular workpiece, such as for example a tube bending machine for bending a length of a tubular workpiece. For example, in one embodiment, the tube bending machine may comprise a forming die defining a curved concave groove, and a fastener proximate a first end of the curved concave groove, the fastener being configured to maintain at least a portion of the workpiece adjacent a first end of the curved concave groove. A counter die defining a linear concave groove may be positionable adjacent the curved concave groove to maintain at least a portion of the workpiece along the curved concave groove. A power source may be configured for driving rotation of the forming die along the curved concave groove in relation to the counter die, whereby rotation of the forming die is adapted to conform at least a portion of the workpiece along the curved concave groove.

In various example embodiments of the present general inventive concept, the tube feeder assembly may comprise a linear member, such as for example a rail, extendable from proximate an interface of the linear and curved concave grooves. A carriage assembly may be mounted to and moveable along the linear member, and a clamp assembly may be reversibly mounted to the carriage assembly. The clamp assembly may be configured to be releasably secured to the workpiece and to carry the workpiece along the linear member with the carriage assembly. Thus, when the linear member is extended from proximate the interface of the linear and curved concave grooves, the clamp assembly and carriage assembly may be configurable to cooperate to carry the workpiece toward the interface along the linear member.

In various example embodiments, the clamp assembly may further comprise a clamping block releasably securable along a central portion of the workpiece. The clamping block may be releasably mountable to the carriage assembly with a first end of the workpiece extending toward a first end of the linear member. The clamping block may be alternately releasably mountable to the carriage assembly with an opposite second end of the workpiece extending toward the first end of the linear member. In some embodiments, the clamping block may comprise upper and lower portions, each of the upper and lower portions defining a substantially semi-cylindrical recess, the recesses being opposable to cooperatively surround and frictionally engage the workpiece. The clamping block may further comprise a plurality of fasteners configured to bias the upper and lower portions toward one another. The clamping block may yet further comprise a plurality of through holes disposed in a configuration symmetrical about an axis perpendicular to an interface of the upper and lower portions, each of the through holes being adapted to receive a fastener therein to mount the clamping block to the carriage assembly. In some embodiments, the plurality of through holes may be disposed along the lower portion.

In certain example embodiments, the carriage assembly may comprise a rotatable disc. The clamping block may be releasably mountable to the disc to align a central axis of a workpiece releasably secured to the clamping block with a central axis of the disc. The carriage assembly may further comprise a base member slidably mounted to the linear member and a planar member extending perpendicular to the linear member. The rotatable disc may be rotatably secured along the planar member. In some embodiments, the planar member may be mounted for slidable adjustment toward and away from the base member. In some embodiments, the planar member may define a circular through opening and a circumferential lip extending about a perimeter of the through opening, the disc being received and retained within the through opening adjacent the lip.

In various embodiments, the disc may define a first cutout extending from a central axis of the disc to an upper perimeter edge of the disc. The planar member may define a second cutout extending from the through opening to a perimeter edge of the planar member. The disc may be rotatable to align the first and second cutouts to allow receipt therethrough of a portion of a workpiece releasably secured to the clamping block. In some embodiments, the disc may define angular measuring indicia about a perimeter surface thereof. In some embodiments, the base member may be pivotable in relation to the linear member.

Additional features, aspects, and advantages of the present general inventive concept will be set forth in part in the description which follows, and, in part, will be apparent from the description, or may be learned by practice of the present general inventive concept.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTION

Figure 1:
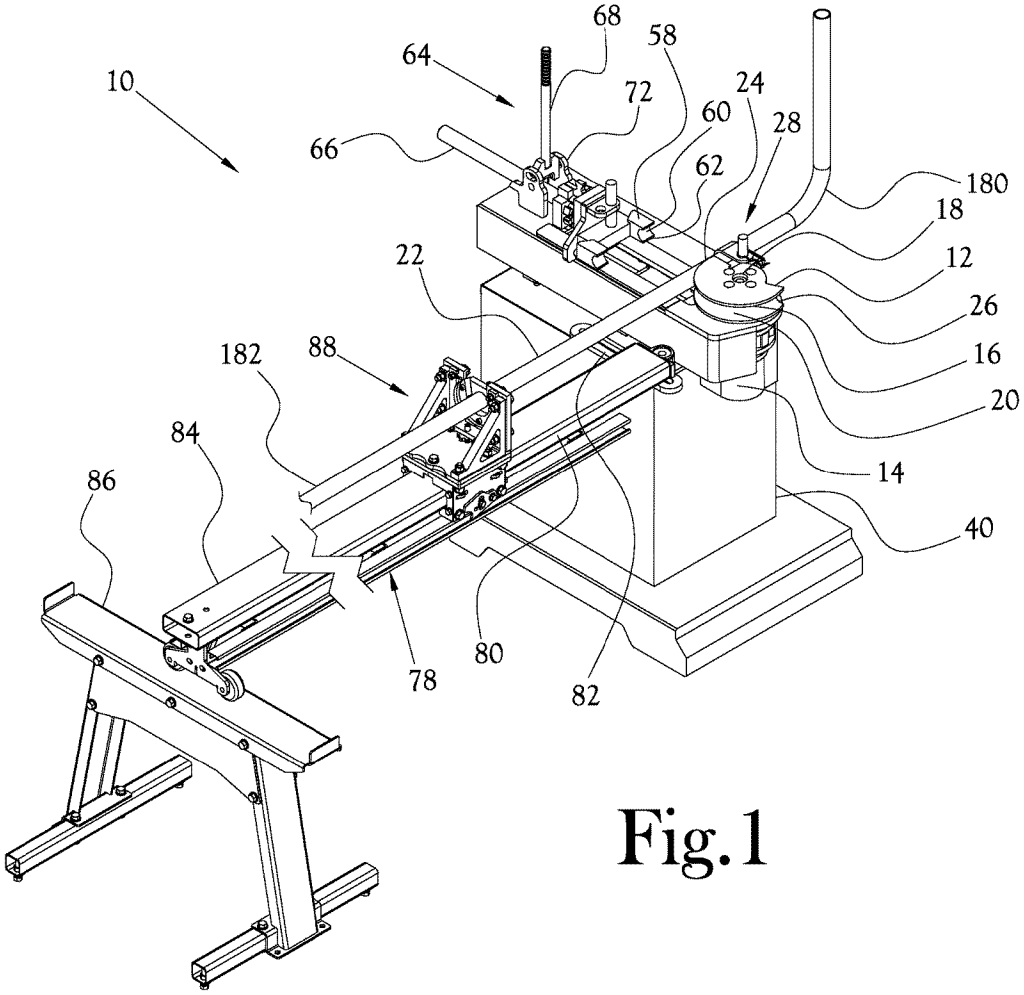
FIG. 1 is a perspective view of one embodiment of a tube bending machine with a reversible clamp assembly constructed in accordance with several features of the present general inventive concept.

Reference will now be made to the example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various examples of the present general inventive concept, a tube bending machine is provided which incorporates a reversible tube clamp assembly. The tube bending machine is configured to receive a portion of a tube and to apply mechanical force to the received portion of tube to conform the received portion of the tube to a bent shape. The reversible clamp assembly is securable to a carriage assembly configured to feed a length of tube to be bent into the tube bending machine, and is repositionable between a forward-facing orientation and a rearward-facing orientation, such that a user may alternately position and secure first and second ends of a tube received within the reversible clamp assembly along a forming die for bending by the tube bending machine without the need to disconnect the tube from the clamp assembly. As will be further discussed hereinbelow, the clamp assembly is securable to the carriage assembly in both forward-facing and rearward-facing orientations in a known orientation in relation to the carriage assembly. Thus, the carriage assembly is capable of maintaining accurate rotational orientation of the tube in relation to the forming die in both forward-facing and rearward-facing orientations, thereby allowing a user to form accurate and precise bends along both of opposite ends of the tube. Thereafter, the reversible clamp assembly is removable from the tube absent the need to slide the tube along the carriage assembly.

FIGS. 1-4 illustrate one embodiment of a tube bending machine 10 constructed in accordance with several features of the present general inventive concept. In the embodiment of FIGS. 1-4, the tube bending machine, or "bender," is of the type of bending machine commonly referred to as a "rotary draw bender" and includes an annular forming die 12 which is mounted in a coaxial configuration to a rotatable spindle 14. The forming die 12 has a perimeter defining a generally semi-circular outer rim portion 16 and a central axis 18 extending from the center of the circle defined by the outer rim portion 16, perpendicular to the outer rim portion 16. A concave forming groove 20 extends along the outer rim portion 16 and defines a leading end 24 and an opposite trailing end 26. The forming groove 20 has a generally semi-circular cross-section which is shaped to at least partially conform to a cross-section of a tube 22 to be bent.

Figure 3:
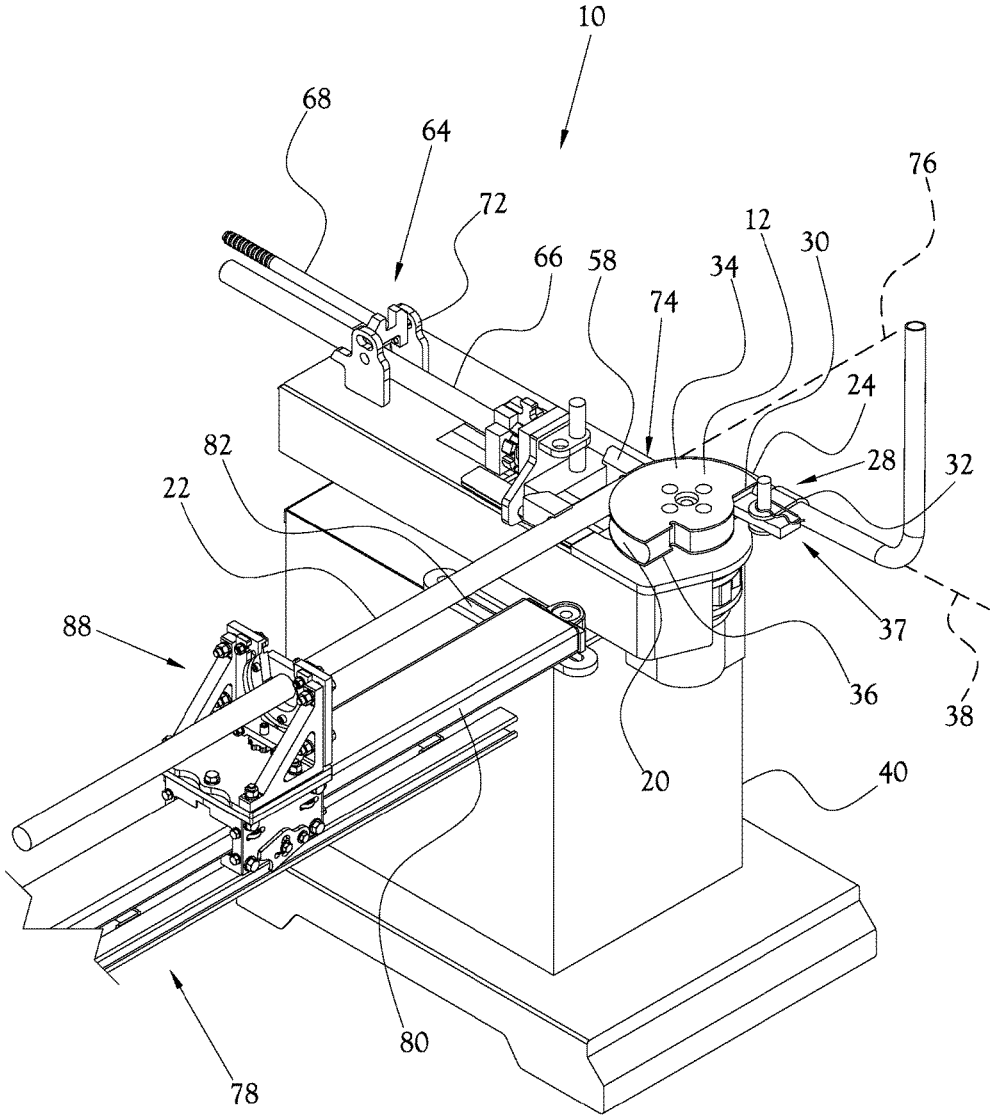
FIG. 3 is a partial perspective view of the tube bending machine of FIG. 1, showing the forming die and pressure die portions in greater detail.
Figure 4:
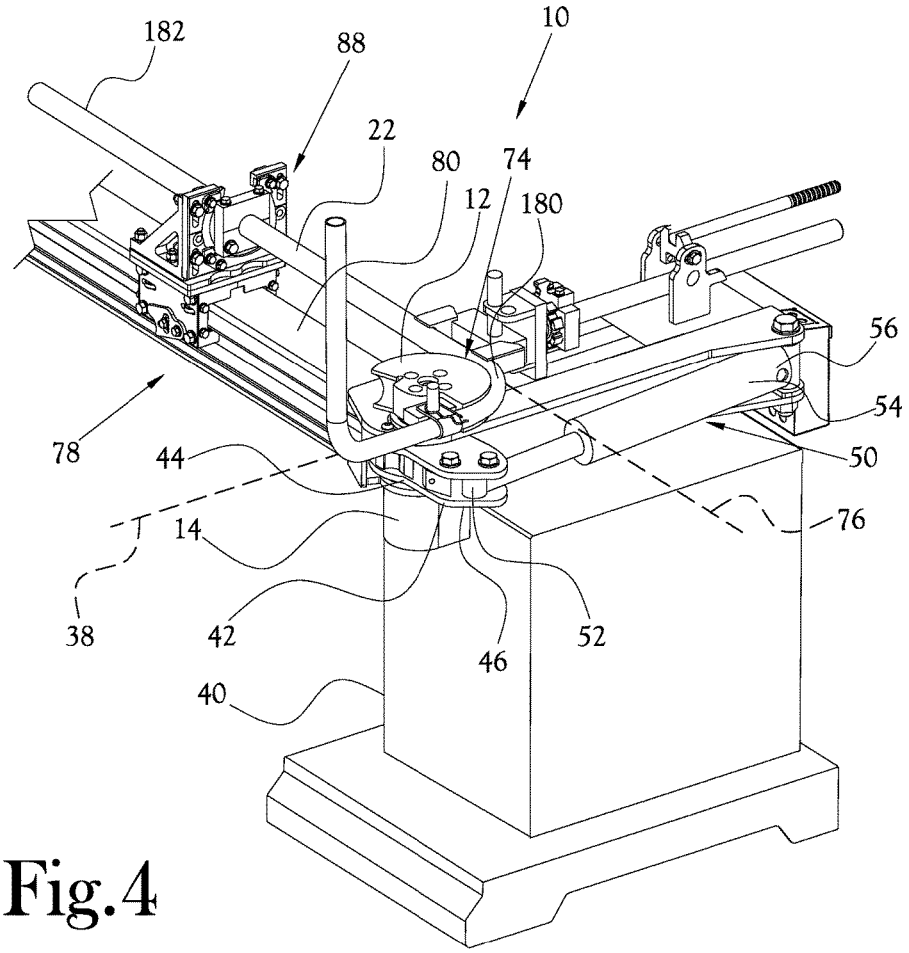
FIG. 4 is another partial perspective view of the tube bending machine of FIG. 1.

As is best shown in FIGS. 3 and 4, a releasable fastener 28 is provided proximate the leading end 24 of the groove 20 and is configured to secure a portion of the tube 22 adjacent the leading end 24 of the groove 20. In the illustrated embodiment, the forming die 12 defines a relatively flat edge portion 30 extending tangentially outwardly from the leading end 24 of the groove 20. The fastener 28 is mounted adjacent the flat edge portion 30 of the forming die 12 and includes a hook-shaped strap portion 32 which is adapted to encircle the tube 22 to secure the tube 22 against the leading end 24 of the groove 20. The strap portion 32 is securable at each of opposite ends to respective upper and lower surfaces 34, 36 of the forming die 12. Thus, the strap portion 32 of the fastener 28 and the leading end 24 of the groove 20 cooperate to define a substantially tubular-shaped inward-facing interface 37 which is configured to closely conform to and engage a portion of the tube 22 to maintain the encircled portion of the tube 22 against the leading end 24 of the groove 20. For ease of reference hereinbelow, it will be recognized that the fastener interface 37 defines a central axis 38 which extends in a substantially straight line outward from, and tangential to, the leading end 24 of the groove 20.

Figure 2:
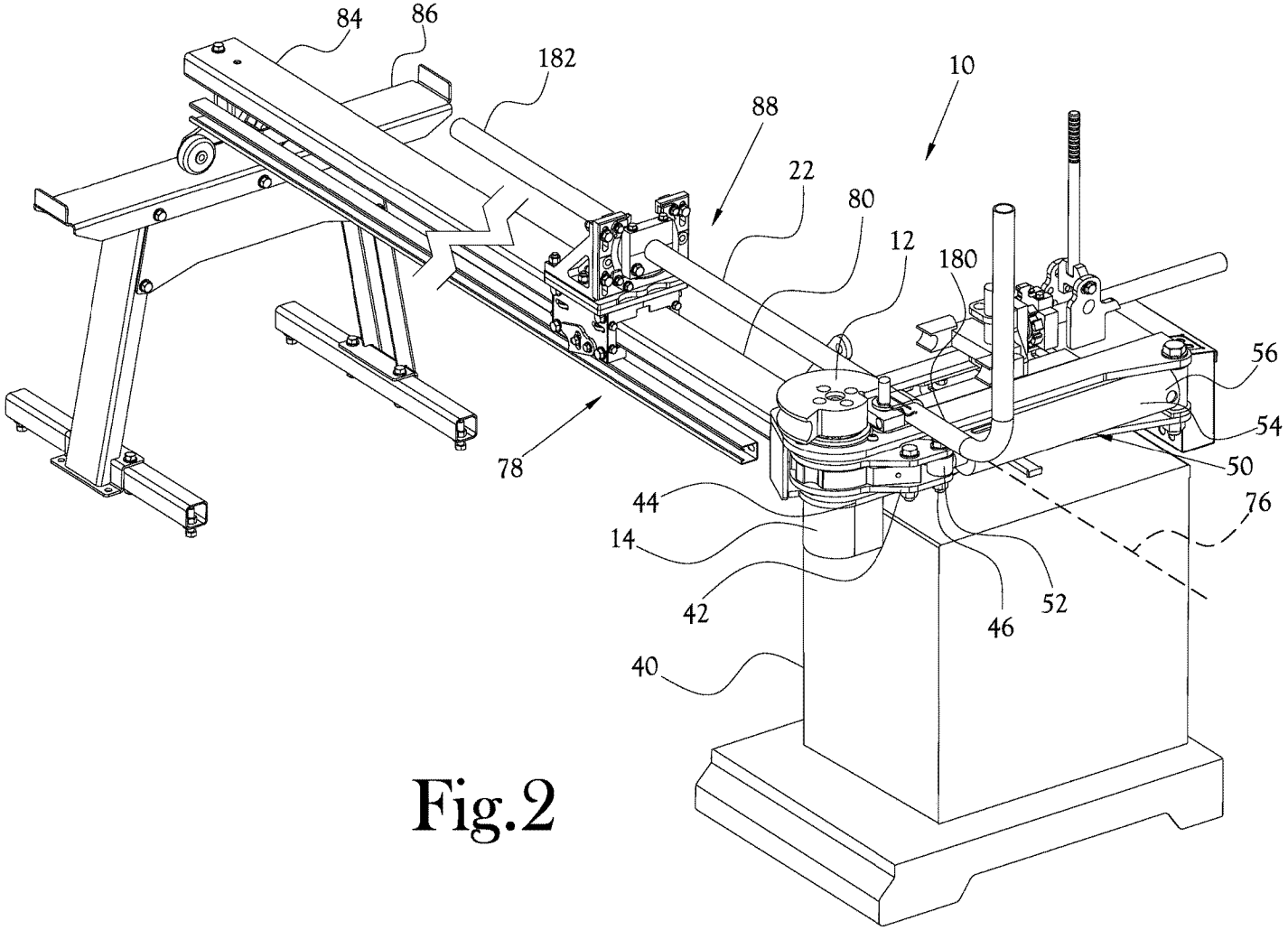
FIG. 2 is another perspective view of the tube bending machine of FIG. 1.

As shown in FIGS. 2 and 4, the spindle 14 is mounted for rotational movement about a central axis thereof in relation to a base structure between a first position (FIG. 2) and a second position (FIG. 4). For example, in the illustrated embodiment, the spindle 14 is rotatably mounted to a bench support 40 via suitable bearings and connections of the type known to one of ordinary skill in the art, such that the coaxis of the spindle 14 and the forming die 12 extend substantially vertically. A first power source 50 is provided for effecting controlled rotation of the spindle 14 and subordinate forming die 12 between the first and second positions. For example, in the illustrated embodiment, a cantilevered moment arm 42 is provided, with a first end 44 of the moment arm 42 fixed in relation to the spindle 14 and extending substantially horizontally outwardly therefrom, perpendicular to the coaxis of the spindle 14 and the forming die 12. A second end 46 of the moment arm 42 is rotatably secured to a first end 52 of a double-acting piston/cylinder device 54. An opposite second end 56 of the double-acting piston/cylinder device 54 is rotatably mounted to a portion of the bench support 40, such that extension of the piston/cylinder device 54 urges rotation of the spindle 14 and forming die 12 from the first position toward the second position, and retraction of the piston/cylinder device 54 urges rotation of the spindle 14 and forming die 12 from the second position toward the first position. The piston/cylinder device 54 may be powered by compressed fluid from a suitable reservoir (not shown), the start, stop, duration and direction of flow of which may be controlled by a conventional controller. Whereas the depicted first power source 50 is of the piston/cylinder type, it will be recognized that other types of power sources may be employed without departing from the spirit and scope of the present invention.

Referring to FIGS. 1 and 3, a pressure die 58 is provided having a generally rectangular peripheral shape and defining a substantially straight, elongated, concave groove 60 at an outer end 62 thereof. The groove 60 of the pressure die 58 is of similar cross-sectional size and shape to the groove 20 of the forming die 12, and the pressure die 58 is oriented such that the groove 60 of the pressure die 58 faces the groove 20 of the forming die 12, with the elongated dimension of the pressure die groove 60 extending along a plane defined by the curved groove 20 of the forming die 12. The pressure die 58 is mounted for linear movement toward and away from the forming die 12, perpendicular to the coaxis of the forming die 12 and the spindle 14, between a first position (FIG. 3), in which the groove 60 of the pressure die 58 is positioned adjacent the groove 20 of the forming die 12, and a second position (FIG. 1), in which the pressure die 58 is moved away from the forming die 12 along the bench support 40.

In various embodiments, a second power source 64 is provided for effecting controlled linear movement of the pressure die 58 between the first and second positions. For example, in the illustrated embodiment, the pressure die 58 is mounted to a rod 66, which is in turn mounted for slidable movement along a long dimension of the rod 66 in relation to the bench support 40. A cantilevered lever arm 68 is provided in mechanical engagement with the rod 66 via a plurality of mechanical linkages 72, such that rotation of the lever arm 68 away from the forming die 12 results in movement of the rod 66 and pressure die 58 toward the forming die 12, thus toward the first position of the pressure die 58, while rotation of the lever arm 68 toward the forming die 12 results in movement of the rod 66 and pressure die 58 away from the forming die 12, thus toward the second position of the pressure die 58. In certain embodiments, the arrangement of the linkages 72 is such that, when the lever arm 68 is rotated sufficiently away from the forming die 12 as to bring the pressure die 58 to the first position, the linkages 72 over-rotate to lock the pressure die 58 in the first position, thereby limiting withdrawal of the pressure die 58 from the first position absent deliberate rotation of the lever arm 68 toward the forming die 12. In other embodiments, the pressure die 58 is secured via suitable linkages to a first end of a double-acting piston/cylinder device, similar to the piston/cylinder device discussed above. An opposite second end of the double-acting piston/cylinder device is mounted to a portion of the bench support 40, such that extension of the piston/cylinder device urges sliding movement of the pressure die 58 toward the first position, and retraction of the piston/cylinder device urges sliding movement of the pressure die 58 toward the second position. Those of skill in the art will recognize other devices and configurations which may be used to accomplish the second power source 64 without departing from the spirit and scope of the present general inventive concept.

Referring to FIG. 3, with the pressure die 58 in its first position, the groove 60 of the pressure die 58 is situated adjacent the groove 20 of the forming die 12. Thus, the pair of grooves 60, 20 cooperate to form a substantially tubular intake interface 74 which is sized and shaped to receive a portion of a tube 22 therein and to maintain the received portion of the tube adjacent the portion of the forming die groove 20 opposite the pressure die 58. When both the forming die 12 and the pressure die 58 are positioned in their respective first positions, the fastener 28 is positioned adjacent the pressure die 58, with the central axis 38 of the fastener interface 37 aligned coaxially with a central axis 76 of the intake interface 74. In this configuration, the pressure die 58 may be withdrawn from the forming die 12 toward its second position, and the fastener 28 may be loosened and/or disconnected from the forming die 12, thereby allowing a straight portion of a tube 22 to be positioned through the intake interface 74 and the fastener interface 37 such that the tube 22 extends along the leading end 24 of the forming die groove 20. Thereafter, the fastener 28 may be tightened and/or secured to the forming die 12, thereby binding the tube 22 against the leading end 24 of the forming die groove 20. The pressure die 58 may be advanced to its first position, and the forming die 12 may be rotated toward its second position, whereupon the portion of the tube 22 trailing the fastener interface 37 is "drawn" along the groove 20 of the forming die 12. With the pressure die 58 in its first position, the pressure die 58 maintains the portion of tube 22 within the intake interface 74 against the groove 20 of the forming die 12, thereby forcing the tube 22 to bend in conformity with the groove 20 of the forming die 12. At the same time, the pressure die 58 and associated groove 60 are configured such that the tube 22 may slide along the length of the groove 60. Thus, as the forming die 12 is rotated toward its second position, additional tube 22 may be drawn through the intake interface 74 and "fed" along the length of the groove 20 of the forming die 12. Thus, it will be recognized that the central axis 76 of the intake interface 74 defines a feeding direction of the bender 10 extending along the central axis 76, toward the fastener 28 when the forming die 12 is in its first position.

In various embodiments, the bender 10 includes a tube feeding and support system which is adapted to support a length of tube 22 to be bent along the feeding direction of the bender 10, coaxial with the central axis 76 of the intake interface 74, and to allow controlled feeding of the tube through the intake interface 74 and along the groove 20 of the forming die 12 during the above-discussed bending process. For example, in the illustrated embodiment, a track 78 is provided at a location slightly below the intake interface 74 of the bender 10 and extending generally horizontally outwardly, parallel to, and opposite of, the feeding direction of the bender 10. More specifically, the track 78 includes a first end 80 which is slidably mounted within a slot 82 defined along the bench support 40. The slot 82 extends generally horizontally beneath the intake interface 74, perpendicular to the feeding direction of the bender 10. Thus, the first end 80 of the track 78 may be repositioned along the slot 82 in order to align the track first end 80 substantially beneath the central axis 76 of the intake interface 74. An opposite second end 84 of the track 78 is carried and supported by a trestle support 86. Suitable adjustment devices are provided to allow leveling and adjustment of the position and of the trestle support 86 and the height of the track second end 84, such that the location of the track second end 84 in relation to the remainder of the bender 10 may be adjusted to bring the track 78 into substantial parallel alignment with the central axis 76 of the intake interface 74.

Figure 5:
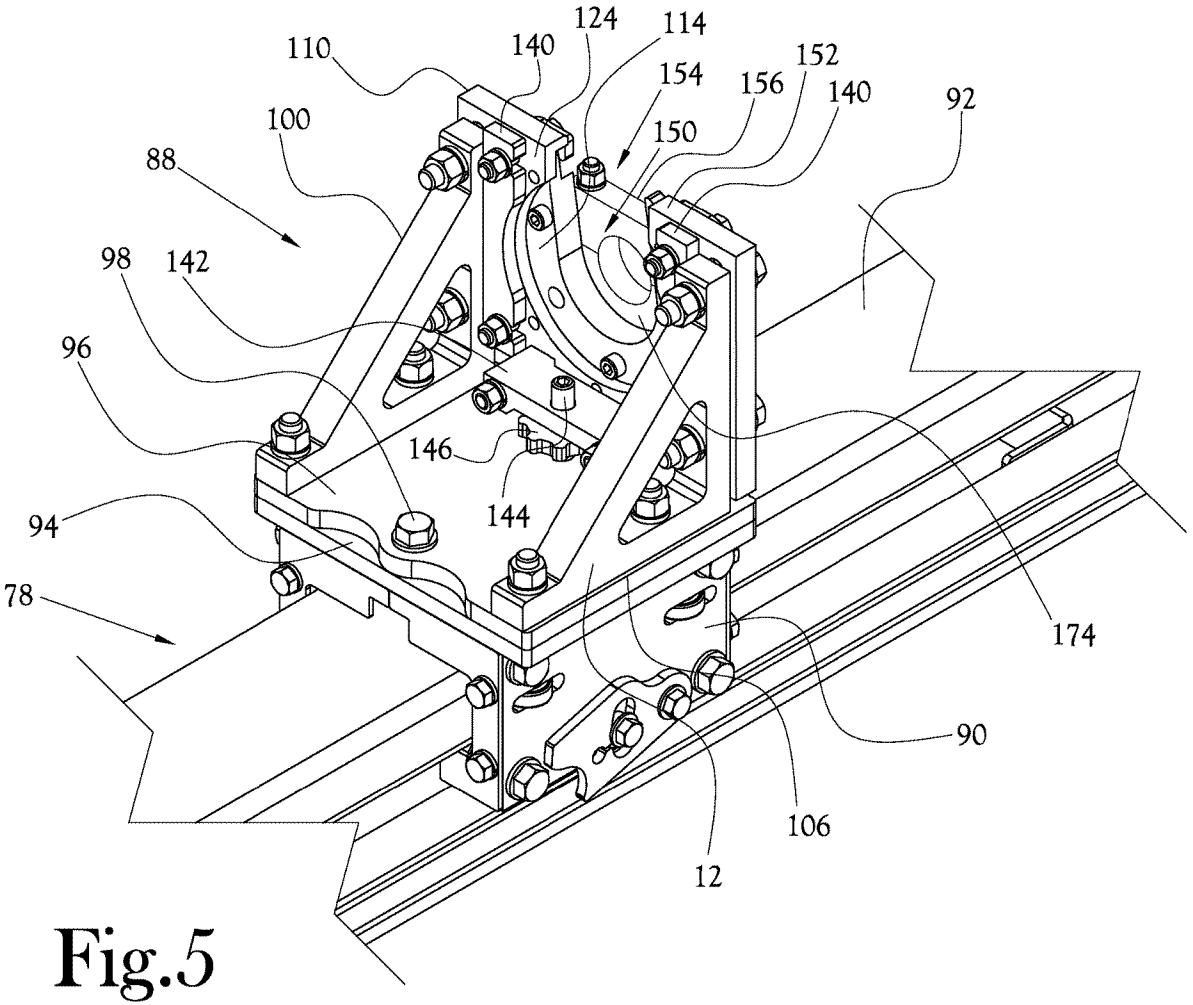
FIG. 5 is a perspective view of one embodiment of a carriage assembly for a tube bending machine incorporating a reversible clamp assembly constructed in accordance with several features of the present general inventive concept.
Figure 6:
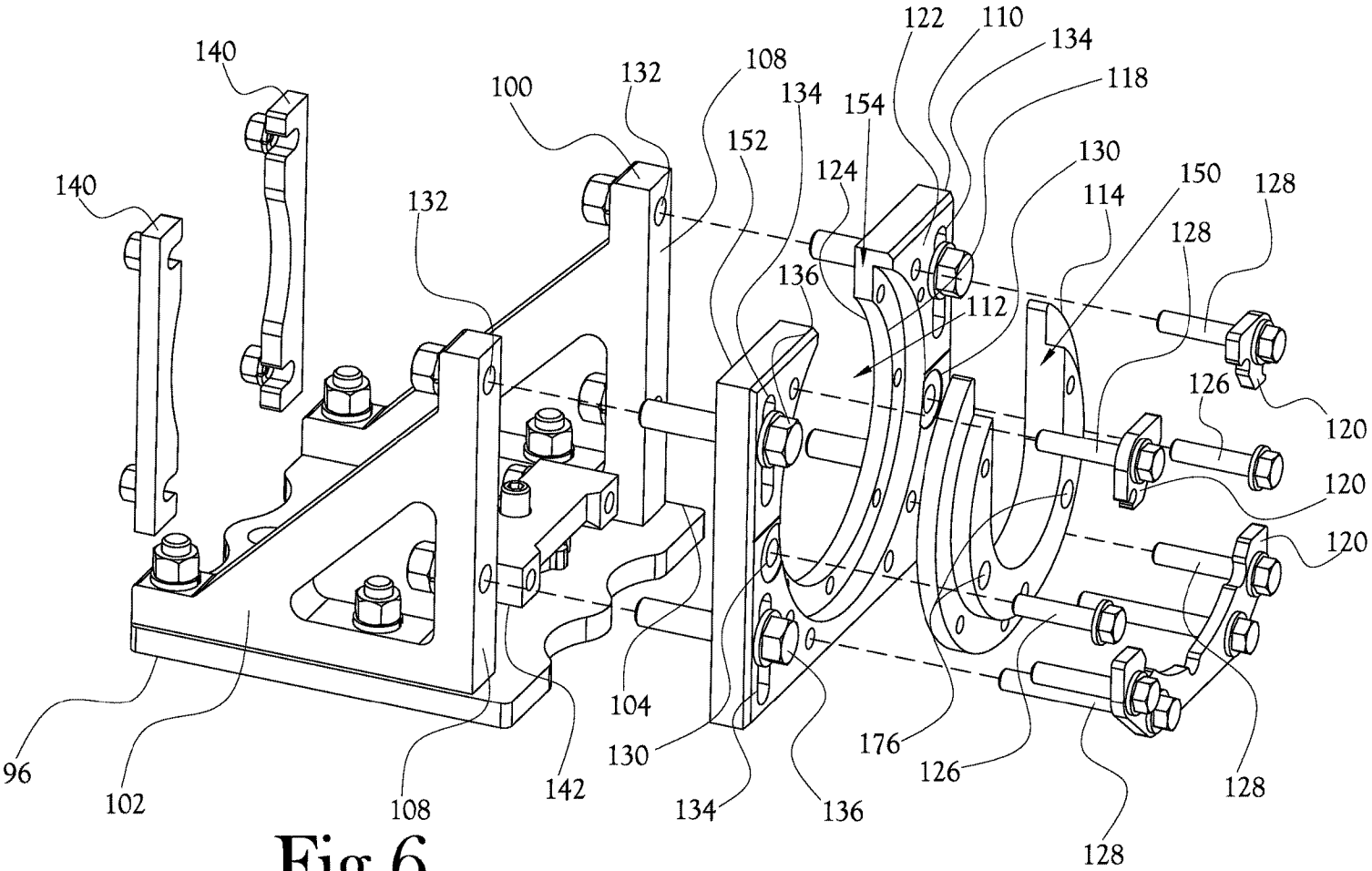
FIG. 6 is an exploded view of a portion of the carriage assembly of FIG. 5.
Figure 7:
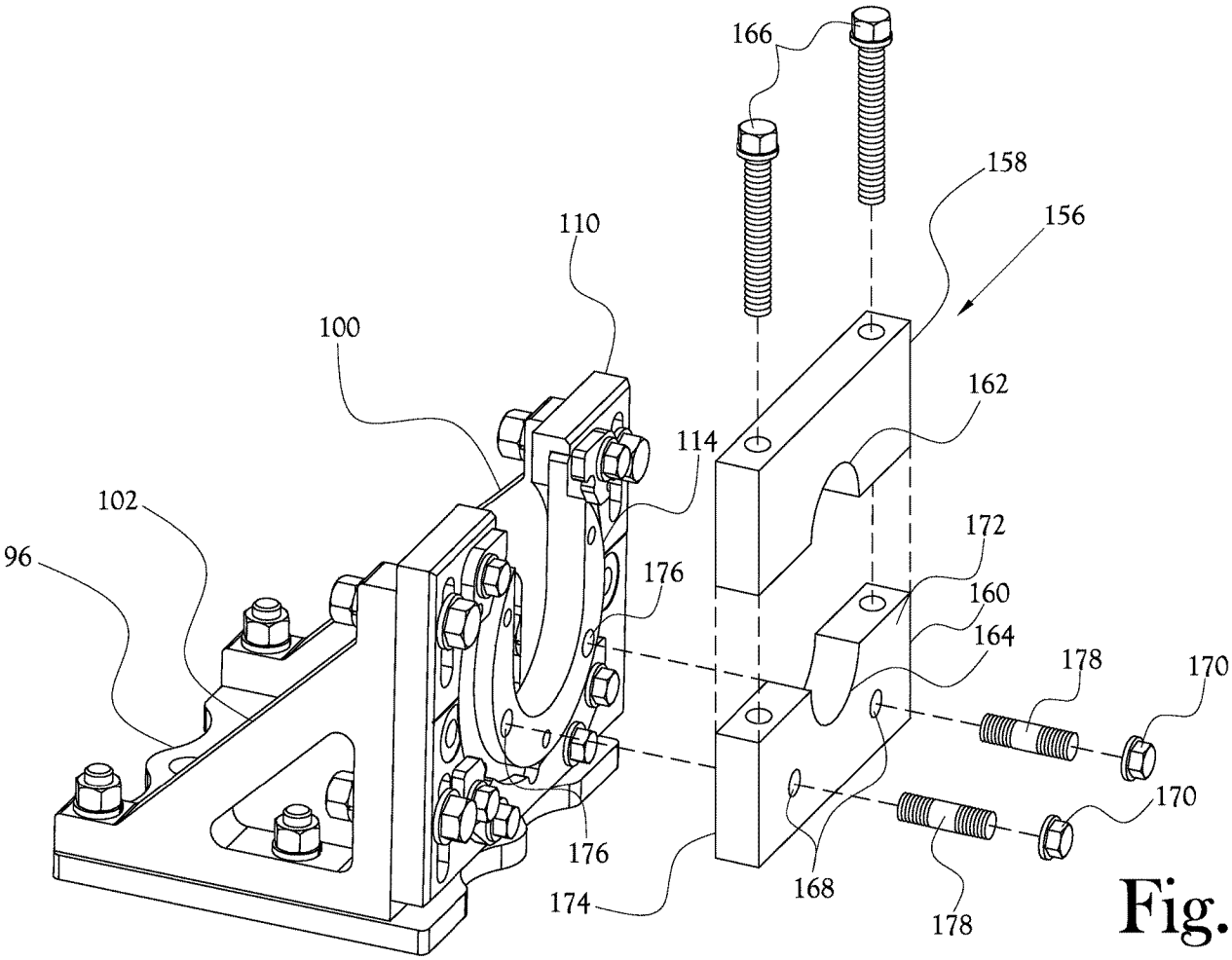
FIG. 7 is an exploded view of another portion of the carriage assembly of FIG. 5.

With reference now to FIGS. 5-7, a carriage assembly 88 is slidably mounted to the track 78. In the illustrated embodiment, the carriage assembly 88 includes a base portion 90 which is shaped to conform to an upper rail portion 92 of the track 78, such that the base portion 90 is slidably secured along, and carried by, the upper rail portion 92. The base portion 90 defines a relatively flat, smooth, upper surface 94. A pivot plate 96 extends in substantially parallel-planar, overlying relationship to the upper surface 94 and is secured thereto via a pin 98 extending perpendicular to the upper surface 94 and the pivot plate 96. Thus, the pivot plate 96 may rotate about the pin 98 along a plane thereof in relation to the base portion upper surface 94. In certain embodiments, the pin 98 is defined by a threaded fastener which is configured to engage an internally-threaded hole defined in the upper surface 94, such that the pin 98 may be tightened in order to secure the pivot plate 96 against rotation in relation to the upper surface 94. In other embodiments, the pin 98 may be defined by a freely rotatable connection.

A carriage plate 110 is provided extending generally upward from, and perpendicular to, the pivot plate 96. The carriage plate 110 is configured to carry and maintain a rotatable disc 114 in parallel-planar relationship to the carriage plate 110, and to allow receipt of a tube 22 along overlying central portions of the disc 114 and the carriage plate 110, such that the tube 22 extends generally along the track 78. For example, in the illustrated embodiment, the carriage plate 110 defines a through opening 112 at a central location thereof, extending perpendicular thereto. A front surface 122 of the carriage plate 110 defines a circular recess 116 extending along a perimeter of the through opening 112, forming a circular lip 118 along a rear surface 124 of the carriage plate 110 about a periphery of the through opening 112. The disc 114 is of a diameter approximately corresponding to, but slightly smaller than, the circular recess 116, such that the disc 114 may be received within the recess 116 and retained therein by the lip 118. A plurality of retainer members 120 are secured to the front surface 122 of the carriage plate 110 in overlying relationship to the disc 114 via suitable fasteners 128, each of which is received through the retainer members 120 and is engaged by one of a plurality of gibs 140 extending along the carriage plate rear surface 124. Thus, the disk 114 is rotatably secured within the recess 116. In various embodiments, additional locks are provided to allow the disc 114 to be selectively secured against rotation in relation to the carriage plate 110 and unlocked to allow such rotation. For example, in the illustrated embodiment, a pair of recessed, internally threaded bores 130 are provided along the front surface 122 of the carriage plate 110, adjacent the circular recess 116. Bolt and washer assemblies 126 are receivable within the bores 130 such that the washer portions overhang the periphery of the disc 114. Thus, the bolt and washer assemblies 126 may be tightened to frictionally engage the disc 114 or loosened to allow the disc 114 to slide in relation to the carriage plate 110. Those of skill in the art will recognize other suitable devices and configurations which may be used to accomplish the above-discussed locking of the disc 114 without departing from the spirit and scope of the present general inventive concept.

In various embodiments, the carriage plate 110 and disc 114 are mounted for slidable adjustment along a vertical direction toward and away from the pivot plate 96. For example, in the illustrated embodiment, a pair of upright braces 100, 102 are provided along each of opposite side edges 104, 106 of the pivot plate 96. The upright braces 100, 102 each define a relatively flat, vertical mounting surface 108 adjacent the rear surface 124 of the carriage plate 110. Each mounting surface 108 defines a plurality of internally-threaded bores 132, each of which corresponds in overlying relationship to one of a plurality of vertically-extending through-slots 134 defined along the carriage plate 110. For each bore 132 and corresponding slot 134, a threaded fastener 136 is provided to extend through the slot 134 and thread into and engage the bore 132. Thus, the carriage plate 110 is slidably mounted along the mounting surfaces 108 of the braces 100, 102. In several embodiments, the threaded fasteners 136 may each be loosened to allow slidable vertical adjustment of the carriage plate 110 in relation to the pivot plate 96 and tightened to fix the carriage plate 110 in relation to the pivot plate 96. Thus, the height of the rotatable disc 114 in relation to the central axis 76 of the intake interface 74 is adjustable, such that the center of the rotatable disc 114 may be aligned with the feeding direction of the bender 10.

In the illustrated embodiment, an adjustable block 142 is provided to allow controlled adjustment of the vertical positioning of the carriage plate 110 in relation to the pivot plate 96. More specifically, in the illustrated embodiment, a threaded shaft 144 is rotatably secured to, and extends upwardly from, the pivot plate 96. A wheel 146 is fixed along, and extends radially outwardly from, the threaded shaft 144, such that rotation of the wheel 146 effects rotation of the shaft 144 about its axis. The block 142 defines an internally-threaded bore which is mated to the external threads of the shaft 144. The block 142 is also fixed to the rear surface 124 of the carriage plate 110. Thus, rotation of the wheel 146 and associated shaft 144 results in translation of the block 142 along the axis of the shaft 144, thereby sliding the carriage plate 110 up or down along the mounting surfaces 108 of the braces 100, 102.

As noted above, in various embodiments, the carriage plate 110 and disc 114 are configured to allow receipt of a tube 22 along overlying central portions of the disc 114 and the carriage plate 110, such that the tube 22 extends generally along the track 78 and toward the intake interface 74. In the illustrated embodiment, the disc 114 defines a U-shaped cavity 150 extending through the thickness of the disc 114 from a central axis of the disc 114 to an upper perimeter edge of the disc 114. Likewise, the carriage plate 110 defines a cutout 154 extending from the through opening 112 through an upper edge 152 of the carriage plate 110. Thus, when the disc 114 is rotated such that the open upper end of the disc 114 overlies the open upper end of the carriage plate 110, a tube 22 may be received therethrough and positioned along a central axis of the disc 114.

With particular reference to FIG. 7, and in accordance with several features of the present general inventive concept, a clamp assembly 156 is provided which is removably securable to a central portion of the tube 22 and which is reversibly securable to the disc 114 in order to fasten and maintain the tube 22 along the central axis of the disc 114. In the illustrated embodiment, the clamp assembly 156 includes a clamping block comprising an upper clamping block portion 158 and a lower clamping block portion 160. The upper and lower clamping block portions 158, 160 define opposing semi-cylindrical recesses 162, 164 which may be mated together to allow the recesses to cooperatively surround and frictionally engage the central portion of the tube 22. The clamp assembly 156 further includes a plurality of fasteners 166 configured to bias the upper and lower clamping block portions 158, 160 toward one another to establish frictional engagement between the semi-cylindrical recess portions 162, 164 and the tube 22.

In the illustrated embodiment, the upper and lower clamping block portions 158, 160 cooperate to define a relatively flat and substantially rectangular overall shape, such that the clamp assembly defines opposite first and second major planar surfaces 172, 174 which extend generally perpendicular to the central axis of the tube 22 when the tube 22 is mounted within the semi-cylindrical recess portions 162, 164. Suitable fasteners may be provided to mount the clamp assembly 156 to the disc 114 with either the first or the second major planar surfaces 172, 174 facing the disc 114 in substantially overlying, parallel-planar relationship with the disc 114 and the carriage plate 110. For example, in the illustrated embodiment, the lower clamping block portion 160 defines a plurality of through holes 168 which are disposed in a configuration symmetrical about a vertical axis of the lower clamping block portion 160 and which extend perpendicular to the first and second major planar surfaces 172, 174. The disc 114 defines a pair of internally-threaded blind bores 176, each blind bore 176 being located along the disc 114 to match a location of a corresponding one of the through holes 168 in the lower clamping block 160 such that, when a tube 22 is mounted in the clamp assembly 156 and the clamp assembly 156 is positioned adjacent the disc 114 with the through holes 168 of the lower clamping block 160 in overlying relationship with the blind bores 176, the tube 22 is received into the U-shaped cavity 150 of the disc 114 and the through opening 112 of the carriage plate 110 and extends along the central axis of the disc 114. A pair of threaded studs 178 are provided, with each threaded stud 178 being partially threaded into a corresponding one of the blind bores 176 and partially extending outwardly therefrom. Each threaded stud 178 is sized to be matingly receivable through a corresponding one of the through holes 168 of the lower clamping block 160. Thus, with the clamp assembly 156 positioned adjacent the disc 114, each threaded stud 178 extends through a corresponding through hole 168 to align the clamp assembly 156 such that the tube 22 extends along the central axis of the disc 114 as discussed above. A fastener nut 170 may then be threaded onto each threaded stud 178 to secure the clamp assembly 156 in the desired position adjacent the disc 114.

From the foregoing, it will be recognized that the above-discussed through holes 168 of the lower clamping block 160, blind bores 176 of the disc 114, threaded studs 178, and fastener nuts 170 provide suitable apparatus to mount the clamp assembly 156 in relation to the disc 114 such that a tube 22 mounted in the clamp assembly 156 may be positioned and maintained along the central axis of the disc 114 in either of two orientations, and more specifically, with either of opposite ends of the tube 22 extending along the track 78 toward the intake interface 74 of the bender 10. It will be recognized that other suitable devices and configurations may be provided by which the clamp assembly 156 may be reversibly secured to the carriage assembly 88, and such configurations may be used without departing from the spirit and scope of the present general inventive concept. It will further be recognized that the above-described features of the track 78 and carriage assembly 88 allow multi-directional adjustability of the positioning of the tube 22 in relation to the intake interface 74 of the bender 10, such that the tube 22 mounted in the carriage assembly 88 may be aligned with the central axis of the intake interface 74 of the bender 10. Thus, in one method of use of the bender 10, the upper and lower clamping block portions 158, 160 may be positioned surrounding a central portion of a substantially straight tube 22 to be bent, with a first end 180 of the tube 22 extending substantially perpendicularly outwardly from the first major planar surface 172 of the clamp assembly 156 and an opposite second end 182 of the tube 22 extending substantially perpendicularly outwardly from the second major planar surface 174 of the clamp assembly 156. The fasteners 166 of the clamp assembly 156 may be secured and tightened to bias the upper and lower clamping block portions 158, 160 toward one another to establish frictional engagement between the semi-cylindrical recess portions 162, 164 and the tube 22.

The disc 114 may be rotated such that the open upper end of the U-shaped cavity 150 overlies the cutout 154 of the upper edge 152 of the carriage plate 110. In this configuration, the central portion of the tube 22 may be received downwardly into the U-shaped cavity 150 of the disc 114 and into the through opening 112 of the carriage plate 110. The clamp assembly 156 may be mounted to the disc 114, thereby aligning the tube 22 along the central axis of the disk 114 with the first end 180 of the tube 22 extending generally toward the intake interface 74. The above-described adjustable features of the track 78 and carriage assembly 88 may then be adjusted to align the tube 22 coaxially with the central axis of the intake interface 74. For example, if necessary, the track 78 may be repositioned along the slot 82 extending beneath the intake interface 74 and the location and/or height of the trestle support 86 may be adjusted to level the track 78 and/or align the central axis of the tube 22 in parallel relationship with the central axis of the intake interface 74. If necessary, the pivot plate 96 may be rotated in relation to the upper surface 94 of the carriage assembly base portion 90 to adjust the angle of extension of the tube 22 in relation to the track 78 along the horizontal plane. Additionally, the height of the carriage plate 110 from the pivot plate 96 may be adjusted to raise or lower the height of the tube 22 from the track 78. Once the tube 22 is aligned coaxially with the central axis of the intake interface 74, the first end 180 of the tube 22 may be fed through the intake interface 74. With the forming die 12 and pressure die 58 in their respective first positions, the tube first end 180 may be secured to the releasable fastener 28 proximate the leading end 24 of the groove 20 of the forming die 12, and the pressure die 58 and forming die 12 may be advanced toward their second positions as described above, thereby forming a first bend proximate the tube first end 180. As the first bend is formed, the carriage assembly 88 may slide along the track 78 toward the intake interface 74, thereby allowing additional tube to be fed through the intake interface 74.

Following formation of the first bend in the tube 22, the releasable fastener 28 may be released, and if desired, additional portions of the tube 22 may be fed through the intake interface 74 by further sliding the carriage assembly 88 along the track 78 toward the intake interface 74. Thereafter, the bending process may be repeated, allowing additional bends to be formed along the tube first end 180 toward the central portion of the tube 22. Most notably, as described above, the disc 114 may be rotated in relation to the carriage plate 110, thereby allowing the tube 22 to be rotated about its central axis in relation to the forming die 12. Thus, bends subsequent to the first bend in the tube 22 may be formed at various other angles to the first bend, allowing a wide variety of shapes to be formed along the tube first end 180. In the illustrated embodiment, angular measuring indicia (not shown) are provided about a perimeter surface of the disc 114. Marking indicia, such as a line, arrow, or other such indicia, are provided along the carriage plate 110 adjacent the measuring indicia, such that as the disc 114 is rotated, the angle of rotation may be monitored to allow for controlled and measured rotation of the disc 114 in relation to the carriage plate 110. Once the disc 114 is rotated to a desired angle, the disc 114 may be fixed in relation to the carriage plate 110, and additional bending of the tube 22 proximate the first end 180 may proceed.

Following bending of the tube 22 proximate the first end 180, the clamp assembly 156 may be removed from the disc 114, and the tube 22 may be removed from the U-shaped cavity 150 of the disc 114 and the through opening 112 of the carriage plate 110. The clamp assembly 156 may be rotated 180 degrees about the vertical axis of the lower clamping block portion 160, and the clamp assembly 156 may be remounted to the disc 114 with the second end 182 of the tube 22 extending toward the intake interface 74. It will be recognized that, due to the symmetry of the through holes 168 in the lower clamping block portion 160, such rotation and remounting of the clamp assembly 156 may be accomplished while maintaining control and measurement of the above-discussed angle of rotation of the disc 114 in relation to the carriage plate 110, and hence the angle of rotation of the tube 22 about its central axis. Thereafter, the second end 182 of the tube 22 may be fed through the intake interface 74. With the forming die 12 and pressure die 58 in their respective first positions, the tube second end 182 may be secured to the releasable fastener 28 proximate the leading end 24 of the groove 20 of the forming die 12, and the pressure die 58 and forming die 12 may be advanced toward their second positions as described above, thereby forming an additional bend in the tube 22 proximate the tube second end 182. The above-described process may be repeated as desired to form additional bends in the tube 22 along the tube second end 182.

It is noted that the above-described simplified diagrams and drawings do not illustrate all the various connections and assemblies of the various components, however, those skilled in the art will understand how to implement such connections and assemblies, based on the illustrated components, figures, and descriptions provided herein, using sound engineering judgment. Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

Having thus described the aforementioned invention, what is claimed is:

1. A tube feeder assembly configured to allow feeding of a tubular workpiece along a central axis of the workpiece, said tube feeder assembly comprising:

a rail;

a carriage assembly slidably mounted along said rail; and a clamp assembly reversibly mounted to and carried by said carriage assembly, said clamp assembly adapted to be releasably secured to the workpiece, said clamp assembly comprising upper and lower portions, each said upper and lower portion defining a substantially semi-cylindrical recess, said recesses being opposable to cooperatively surround and frictionally engage the workpiece, said clamp assembly further comprising a plurality of through holes disposed along said lower portion in a configuration symmetrical about an axis perpendicular to an interface of said upper and lower portions, each said through hole being adapted to receive a fastener therein to mount said clamp assembly to said carriage assembly;

whereby said clamp assembly and carriage assembly are configurable to align the workpiece central axis along said rail, whereby sliding of said carriage assembly with the workpiece mounted in said clamp assembly carries the workpiece along said rail.

2. The tube feeder assembly of claim 1, said carriage assembly comprising a disc extending perpendicular to said rail, said disc being rotatable about a central axis thereof, said clamp assembly being fixed in relation to said disc.

3. The tube feeder assembly of claim 2, said disc defining a cutout extending from a central axis of said disc to an upper perimeter edge of said disc, whereby when the workpiece is releasably secured to the clamp assembly, the workpiece is aligned coaxially with the disc and is received within the cutout.

4. The tube feeder assembly of claim 3, said disc being adjustably repositionable in a direction perpendicular to said rail.

* * * * *